United States Patent [19]

Hosan et al.

[11] Patent Number: 4,848,524

[45] Date of Patent: Jul. 18, 1989

[54] TELESCOPIC APPLIANCE

[75] Inventors: Hans-Josef Hosan, Neuwied; Gregor Poertzgen, Koblenz, both of Fed. Rep. of Germany

[73] Assignee: Stabilus GmbH, Koblenz-Neuendorf, Fed. Rep. of Germany

[21] Appl. No.: 81,236

[22] Filed: Aug. 4, 1987

[30] Foreign Application Priority Data

Aug. 9, 1986 [DE] Fed. Rep. of Germany ..... 3627138

[51] Int. Cl.[4] ..... F16F 9/36

[52] U.S. Cl. ..... 188/322.17; 267/64.26; 277/169; 277/197; 277/215; 384/32

[58] Field of Search ..... 267/141.4, 141.5, 64.12, 267/64.13, 64.11, 113, 129, 131, 117, 64, 26; 188/322.16, 322.17, 322.18; 277/169, 227, 192, 197, 215, 100; 384/26, 29, 32, 37, 38, 42, 192, 202, 203, 208

[56] References Cited

U.S. PATENT DOCUMENTS

| | | | |
|---|---|---|---|
| 738,129 | 9/1903 | Tucker | 277/100 |
| 3,226,141 | 12/1965 | Sullivan | 384/203 |
| 3,464,882 | 9/1969 | Motorn | 384/42 |
| 3,683,754 | 8/1972 | Stuyvenberg | 384/202 |
| 3,711,054 | 1/1973 | Bauer | 248/400 |
| 4,108,416 | 8/1978 | Nagese et al. | 267/131 |
| 4,408,924 | 10/1983 | Huebner | 277/197 |
| 4,511,277 | 4/1985 | McCabe | 384/203 |

FOREIGN PATENT DOCUMENTS

| | | | |
|---|---|---|---|
| 964684 | 7/1964 | United Kingdom | 277/169 |

*Primary Examiner*—Andres Kashnikow
*Assistant Examiner*—Mark T. Le
*Attorney, Agent, or Firm*—Brumbaugh, Graves, Donohue & Raymond

[57] ABSTRACT

In a telescopic apparatus, an inner telescopic part is axially displaceable in wobble-free manner in an outer telescopic part. For the guidance of the inner telescopic part a carrier sleeve is inserted into the outer telescopic part. The carrier sleeve accommodates at least one guide ring body in universal joint manner. This guide ring body possesses a guide surface section which rests on the outer telescopic part.

18 Claims, 3 Drawing Sheets

TELESCOPIC APPLIANCE

The invention relates to a telescopic appliance comprising an outer telescopic part with a cavity which has an axis, an inner telescopic part at least partially accommodated by the cavity with an external guide surface which is movable in the direction of the axis in relation to the outer telescopic part linearly and substantially wobble-freely and an annular guide unit inserted into the outer telescopic part with an inner guide surface arrangement for abutment on the outer guide surface of the inner telescopic part.

Such telescopic appliances occur especially in chair columns where the outer telescopic part is formed by an upright tube of the chair column and the inner telescopic part is formed by a jacket tube of a gas springs, while the piston rod of the gas spring is firmly connected in the axial direction with an end of the upright tube.

DISCUSSION OF THE PRIOR ART

From DE-PS No. 1,931,012 a gas spring blockable at will is known the cylinder outer surface of which is arranged sliding in a guide bush connected with an upright tube. The guide bush is pressed into the upright tube and thus forms a most extensively rigid sliding guide, even if it consists of a synthetic plastics material. Especially when such a guide is used as chair column a bending stress occurs as a result of eccentric loading, whereby tilting occurs between the cylinder outer surface and the upright tube, having the effect of high break-away forces, increased friction and thus high axial forces upon the guide. These difficulties also occur in the case of inexact alignment of the gas spring with the upright tube, whereby expensive finishing working becomes necessary. It is further disadvantageous that in the adjustment of height and in the rotating movement of a chair seat connected with the gas spring cylinder in relation to the upright tube, united with a chair pedestal, increased wear of the guide bush occurs due to the friction and edge pressure.

OBJECTS OF THE INVENTION

The object of the present invention is to produce a telescopic appliance, especially for use as chair column, in which satisfactory sliding and rotation of the inner telescopic part in relation to the outer telescopic part are rendered possible and thus axial movement resistances are substantially reduced. Defects of alignment are to be compensated without the occurrence of higher friction or edge pressure. Over a very long operational duration the wear of the participating elements should be as low as possible. Assembling of the telescopic appliance is to be simplified.

SUMMARY OF THE INVENTION

The invention is based upon a telescopic appliance comprising an outer telescopic part with a cavity having an axis, an inner telescopic part at least partially accommodated by the cavity with an outer guide surface which is movable in the direction of the axis in relation to the outer telescopic part linearly and substantially wobble-freely and an annular guide unit inserted into the external telescopic part with an internal guide surface arrangement for abutment on the outer guide surface of the inner telescopic part.

It is here provided that at least one inner guide surface section of the inner guide surface arrangement is formed on a guide ring body which is mounted in universal joint manner on a carrier sleeve of the guide unit. Since the inner telescopic part is to be wobble-freely movable within the outer telescopic part, provision must be made for two guide points, spaced in the axial direction, between the outer guide surface and the inner guide surface arrangement. These guide points are cylindrical surfaces and must lie in the most exact possible axial alignment with regard to a satisfactory low-friction guidance. If now in accordance with the invention at least one inner guide surface section of the inner guide surface arrangement is formed on a guide ring body which is mounted in universal joint manner on a carrier sleeve of the guide unit, the two axially spaced guide points adjust themselves automatically to approximately exact alignment, so that a satisfactory guidance is guaranteed without substantial tilting friction.

The guide ring body can be accommodated in an internal circumferential groove on the inside of the carrier sleeve.

In order to obtain a mounting in universal joint manner, free from return forces, of the guide ring body in the carrier sleeve, the circumferential groove can be made with a surface of partial hollow sphere form and the guide ring body can be provided with a partially spherical external surface which rests on the surface of partial hollow sphere form.

In order that the guide ring body may be installed easily in the carrier sleeve it is provided that the carrier sleeve is formed from two half shells which after reception of the guide ring body are pushed into the cavity and thus held together.

According to a preferred form of embodiment two guide ring bodies are arranged with axial spacing within the carrier sleeve, each of which is mounted in universal joint manner in relation to the carrier sleeve. In this form of embodiment a satisfactory axial alignment is guaranteed on two cylindrical guide surface sections, since these guide surface sections can be automatically centred in exact axial alignment in relation to one another.

Thus it is guaranteed that the outer guide surface of the inner telescopic part is guided with low friction in two cylindrical surfaces spaced in the axial direction.

Another simple possibility of installation of one or more guide ring bodies in a carrier sleeve is obtained in that the carrier sleeve is provided over a partial section of its axial length with slots open at one end and in that the internal circumferential groove is formed in this partial section. The guide ring body can then be snapped into the internal circumferential groove by opening out of the slotted section of the carrier sleeve.

The carrier sleeve can be made from synthetic plastics material or metal, especially light metal, especially in the form of an injection-moulding.

The guide ring body consists preferably of metal or sintered metal and can carry a coating of slip-favourable material on its internal surface. This coating of slip-favourable material does not have to be applied directly on the internal surface of the guide ring body but can also be arranged on the internal surface of a slide bush which is inserted with its external surface into the guide ring body.

The outer telescopic part may be formed by an upright tube of a chair column which possesses an end piece at its lower end and is open at its upper end while on the other hand the internal telescopic part can be formed by a jacket tube of a gas spring which has a piston rod secured axially to the end piece of the upright tube.

In such upright tubes it is undesired to use the gas spring piston rod for the radial securing of the gas spring. It is therefore necessary to guide the jacket tube of the gas spring in the guide unit at two guide points situated with axial spacing. Each of these guide points is preferably formed by a guide ring body mounted in universal joint manner in the carrier sleeve. However it is fundamentally also conceivable to form only one of the guide points by a guide ring body mounted in universal joint manner, preferably the upper guide point, and to form the other guide point as a cylindrical guide surface which is rigidly arranged on the carrier sleeve and is as short as possible in the axial direction. In order to avoid the introduction of bending forces into the bar body formed from the jacket tube and the piston rod it is advisable to secure the piston rod on the end piece of the upright tube with radial play.

The various new features of the invention will be set forth especially in the accompanying Patent Claims. These patent claims are a part of the disclosure. For better understanding of the invention, its advantages and its specific effects reference is made to the accompanying drawings and to the description of these drawings, in which preferred examples of embodiment of the invention are set forth.

BRIEF DESCRIPTION OF THE DRAWINGS

The invention will now be described in detail with reference to the form of embodiment represented in the drawings, wherein:

In FIG. 1 there is shown a chair column comprising a gas spring 1 which can be blocked at will. A jacket tube 2 of the gas spring 1 is guided in a guide unit 9 which is pressed into the upper end of an upright tube 8. The gas spring 1 possesses a piston rod 3 which is mounted with its lower end rotatably, axially fixedly and with radial play on an end piece 8*a* of the upright tube 8. The jacket tube 2 possesses at its upper end a conical securing section 2*a* which can be introduced into a correspondingly conical hollow hub of a chair seat. The upright tube 8 possesses at its lower end a conical section 8*b* which can be introduced into a correspondingly conical bore of the chair pedestal. The piston rod 3 is connected within the gas spring 2 with a piston 4 which separates two working chambers 5 and 6 from one another within the gas spring. The two working chambers 5 and 6 are at least partially filled with gas under pressure. The two working chambers 5 and 6 are connectable with one another by a by-pass connection 20 bridging over the piston 4. This by-pass connection 20 is shut off by a valve device 7. The by-pass connection 20 can be opened by axial pressure upon the valve device 7 so that a fluid exchange can take place between the two working chambers 5 and 6. When the valve device 7 is closed a specific outward thrust length of the gas spring 1 is set. In order to vary the outward thrust length the valve device 7 must be opened. Then the pressure medium within the working chambers 5 and 6 seeks to push the piston rod 3 out of the gas spring until the valve device 7 is closed again. A part of the working chambers 5 and 6 can also be filled with liquid.

In the vertical adjustment of the jacket tube 2 in relation to the upright tube 8 the jacket tube 2 slides in the guide unit 9. Sliding also takes place when the compressed gas within the working chamber 6 is more or less strongly compressed due to alternating loading on the chair seat.

Figure 2:
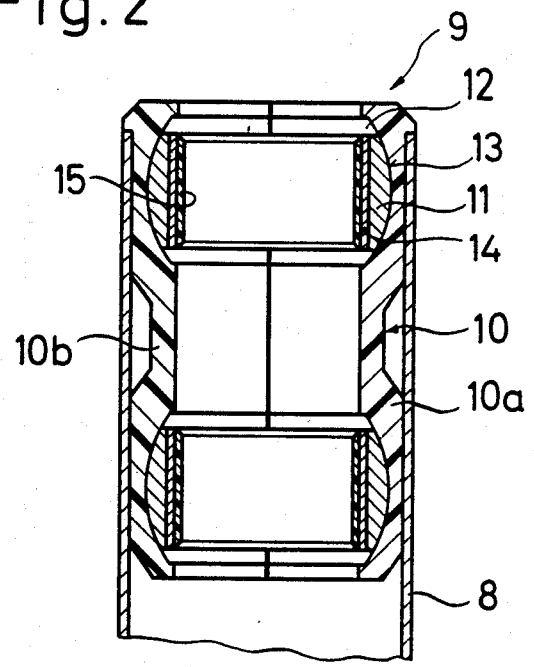
FIG. 2 shows a partial section through the upright tube and the guide unit inserted into the upright tube.
Figure 3:
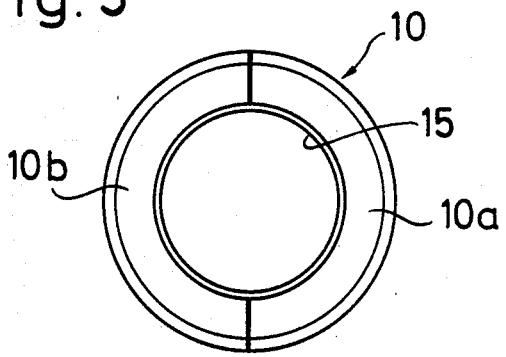
FIG. 3 shows a plan view of the guide unit.

The guide unit 9 is represented in detail in FIGS. 2 and 3. It comprises a carrier sleeve 10 which is composed of two part shells 10*a* and 10*b*. On the inner side of the carrier sleeve 10 two internal circumferential grooves 12 are formed with axial spacing from one another each possessing a surface 13 of partial hollow spherical form. Into the inner circumferential groove 12 a guide ring body 11 is inserted which possesses an external surface of part spherical form. A slide bush 14 carrying a synthetic plastics coating 15 is inserted into the guide ring body 11. The internal circumferential surface of the synthetic plastics coating 15 has a smaller radius than the internal circumferential surface of the carrier sleeve 10.

In assembly the following procedure is adopted. The jacket tube 2 of the gas spring 1 is pushed through the two guide ring bodies 11. The guide ring bodies are then inserted into the internal circumferential grooves 12 of the one half shell 10*a*. The other half shell 10*b* is applied to complete the carrier sleeve 10. Then the carrier sleeve 10 is pushed into the upright tube 8, the lower end of the piston rod 3 penetrating the end piece 8*a* of the upright tube 8. Now the lower end of the piston rod 3 is made fast on the end piece 8*a* by a securing ring 21.

Figure 1:
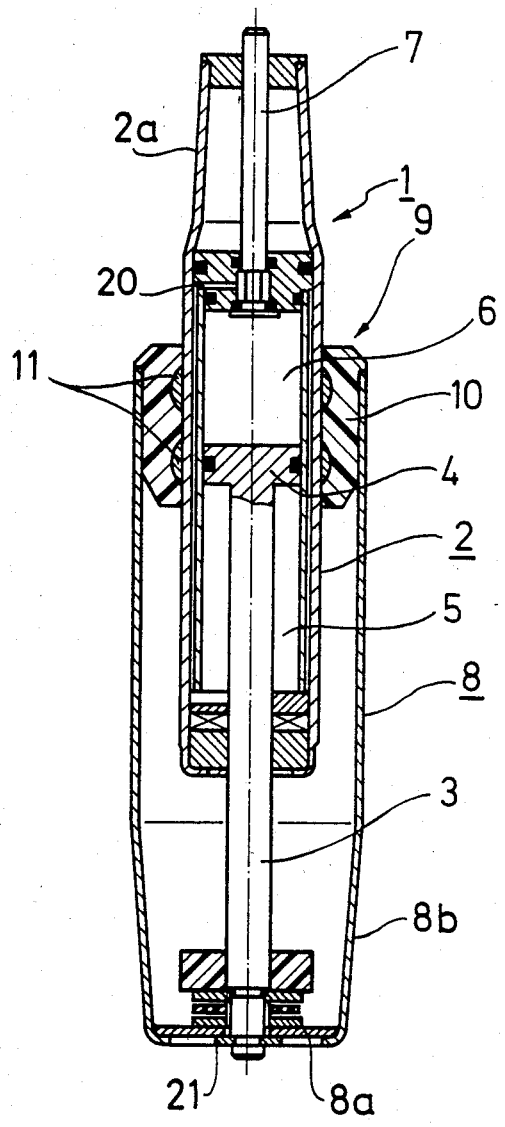
FIG. 1 shows a longitudinal section through a a chair column.

As may be seen from FIG. 1, the lower end of the piston rod 3 has radial play in the end piece 8*a*. The guide ring bodies 11 automatically align themselves in the insertion of the jacket tube 2. When they are once aligned, the jacket tube 2 is accommodated in bending resistant manner and wobble-freely by the carrier sleeve 10 and thus by the upright tube 8. Since the piston rod 3 has radial play in the end piece 8*a* there is no possibility of the action of a bending moment upon the piston rod 3, not even if the chair seat is eccentrically loaded. Since the guide ring bodies 11 rest with their synthetic plastics slip coating 15 in constraint-free manner on the jacket tube 2, a low friction guidance is guaranteed. Any temperature-caused expansions of the carrier sleeve 10 do not influence the guide properties. Since the guide ring bodies 11 consist of metal, especially steel, or sintered metal, the internal diameter of the slip coatings 15 remains substantially constant.

Figure 4:
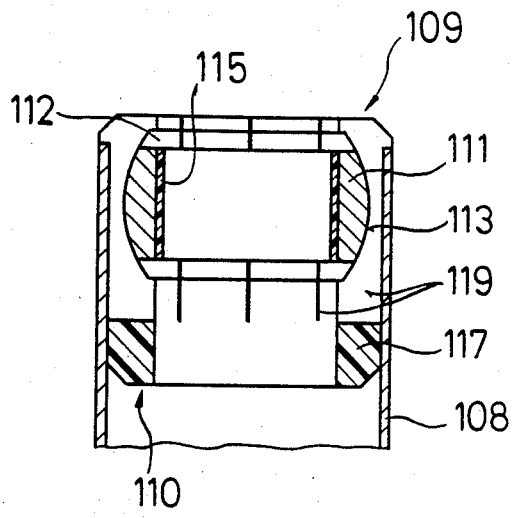
FIG. 4 shows a section corresponding to that in FIG. 2 through a further form of embodiment of a guide unit and FIG. 5 shows the plan view of the guide unit according to FIG. 4.
Figure 5:
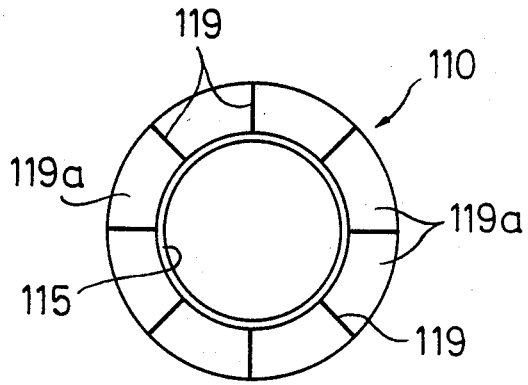

The guide unit 109 according to FIGS. 4 and 5 differs from the guide unit 9 according to FIGS. 1 to 3 essentially in that a single guide ring body 111 is inserted in universal joint manner into an internal circumferential groove 112 and/or into its surface 113 of partial hollow spherical form. The carrier sleeve 110 possesses a closed ring section 117 and slots 119 forming spring tongues 119*a* above the closed ring section 117. By reason of these slots 119 the upper part section of the carrier sleeve 110 can be spread apart by pressing in of the guide ring body 111 from above until the guide ring body 111 snaps into the internal circumferential groove 112. The guide ring body 111 in this form of embodiment is directly coated with a slip-favouring synthetic plastics coating 115. In this form of embodiment the jacket tube, beside its guidance in the guide ring body 111, can also possess a direct guidance in the closed ring section 117. In this way again a wobble-free guidance of the jacket tube is obtained. Since the guide ring body 111 here again can adjust itself, here again a low-friction guidance is obtained.

Special forms of embodiment of the invention have been represented and described in order to explain the utility of the principle of the invention. It is however pointed out that the invention can also be realised in other ways without departure from the principle.

The references in the claims serve only to facilitate understanding and are not to be understood as a limitation.

We claim:

1. Telescopic apparatus, comprising an outer telescopic part (8) with a cavity which has an axis, an inner telescopic part (2) at least partially accommodated by the cavity with an outer guide surface which is movable in the direction of the axis in relation to the outer telescopic part (8) linearly and substantially wobble-free and an annular guide unit inserted into the outer telescopic part (8), with an internal guide surface arrangement for abutment on the external guide surface of the inner telescopic part (2), wherein at least two inner guide surface sections of the inner guide surface arrangement are formed on two partially spherical guide ring bodies (11) which are mounted in universal joint manner on a carrier sleeve (10) of the guide unit (9).

2. Telescopic apparatus according to claim 1, characterised in that each guide ring body (11) is accommodated in a corresponding internal circumferential groove (12) on the inside of the carrier sleeve (10).

3. Telescopic apparatus according to claim 2, characterised in that each circumferential groove (12) is made with a surface (13) of partial hollow spherical form and in that each guide ring body (11) possesses a part-spherical external surface which rests on the surface (13) of said partial hollow spherical form.

4. Telescopic apparatus according to claim 3, characterised in that the carrier sleeve (10) is formed from two half shells (10*a*, 10*b*) which, after the reception of the guide ring bodies (11), are pushed into the cavity and thus held together.

5. Telescopic apparatus according to claim 4, characterised in that the two half shells (10*a*, 10*b*) are pressed into the cavity.

6. Telescopic apparatus according to claim 2, characterised in that the carrier sleeve (110) is provided on a partial section of its axial length with slots (119) open at one end and in that one of the the internal circumferential grooves (112) is formed in this partial section.

7. Telescopic apparatus according to claim 1, characterised in that the carrier sleeve (10) is formed from synthetic plastics material.

8. Telescopic apparatus according to claim 1, characterised in that the carrier sleeve (10) is made from metal.

9. Telescopic apparatus according to claim 8, characterised in that the guide ring bodies (11) are produced from sintered metal.

10. Telescopic apparatus according to claim 1, characterised in that each guide ring body (11) carries on its internal surface a coating (15) of slip-favouring material.

11. Telescopic apparatus according to claim 10, characterised in that the coating (15) of slip-favouring material is arranged on the internal surface of a slide bush (14) which is inserted with its external surface into the guide ring body (11).

12. Telescopic apparatus according to claim 1, characterised in that the outer telescopic part (8) is formed by an upright tube (8) of a chair column which possesses an end piece (8*a*) at its lower end and is open at its upper end and in that the inner telescopic part is formed by a jacket tube (2) of a gas spring (1) which possesses a piston rod (3) axially secured to the end piece (8*a*).

13. Telescopic apparatus according to claim 12, characterised in that the two guide ring bodies (11) are spaced in the axial direction and in that the piston rod (3) is secured to the end piece (8*a*) with radial play.

14. A telescopic apparatus for use as a chair column, comprising an outer telescopic tube (8) having an open upper end and a lower end piece (8*a*), an inner telescopic tube comprising a cylinder (2) of a gas spring (1), a piston rod (3) of the gas spring being axially secured at its lower end to the end piece (8*a*), and an annular guide unit (9) inserted into the outer telescopic tube (8) for guiding the gas spring cylinder (2) in axial, substantially wobble-free movement relative to the outer tube (8), characterized in that the annular guide unit (9) comprises a carrier sleeve (10) and two axially-spaced guide ring bodies (11) having internal surfaces for sliding engagement with the external surface of the gas spring cylinder (2), each guide ring body (11) having a generally convex external surface which is received in a universal joint manner in a complementary, generally concave surface (13) formed on the internal surface of the carrier sleeve (10), and the lower end of the piston rod (3) being secured to the end piece (8*a*) with radial play.

15. Telescopic apparatus according to claim 14 characterized in that the guide ring bodies (11) are substantially radially fixed with respect to the outer telescopic tube (8) and the carrier sleeve (10) is divided in the axial direction into two semi-annular shells (10*a*, 10*b*) which, after the reception therein of the guide ring bodies (11), the shells (10*a*, 10*b*) are inserted into the open upper end of the outer tube (8) and thus are held together.

16. A telescopic apparatus for use as a chair column, comprising an outer telescopic tube (8) having an open upper end and a lower end piece (8*a*), an inner telescopic tube comprising a cylinder (2) of a gas spring (1), a piston rod (3) of the gas spring being axially secured at its lower end to the end piece (8*a*), and an annular guide unit (9) inserted into the outer telescopic tube (8) for guiding the gas spring cylinder (2) in axial, substantially wobble-free movement relative to the outer tube (8), characterized in that the annular guide unit (9) comprises a carrier sleeve (10) having two closed ring sections (117) adjacent the axial ends thereof and an axially-spaced guide ring body (11) located within each closed ring section, each guide ring body (11) having an internal surface for sliding engagement with the external surface of the gas spring cylinder (2), each guide ring body (11) having a generally convex external surface which is received in a universal joint manner in a complementary, generally concave surface (13) formed by an internal circumferential groove (12) of the inside of the carrier sleeve (10), the carrier sleeve (10) being provided with circumferentially-spaced slots (119) formed over each closed ring section and extending axially from the adjacent open end of the sleeve (10)

over a portion of the length of the sleeve (10) in which the circumferential groove (12) is formed.

17. A telescopic apparatus for use as a chair column, comprising an outer telescopic tubular unit (8) having an open upper end and a lower end piece (8*a*), an inner telescopic tubular unit, comprising a gas spring (1), having a cylinder (2) and a piston rod (3), the piston rod (3) of the gas spring being axially secured at its lower end to the end piece (8*a*), and an annular guide unit (9) inserted into the outer telescopic unit (8) for guiding the inner telescopic unit in axial, substantially wobble-free movement relative to the outer unit (8), characterized in that the annular guide unit (9) comprises a carrier sleeve (10) and two axially-spaced guide ring bodies (11) having internal surfaces for sliding engagement with the external surface of the inner telescopic tubular unit, each guide ring body (11) having a generally convex external surface which is received in a universal joint manner in a complementary, generally concave surface (13) formed on the internal surface of the carrier sleeve (10), and the lower end of the piston rod (3) being secured to the end piece (8*a*) with radial play.

18. A telescopic apparatus for use as a chair column, comprising an outer telescopic tubular unit (8) having an open upper end and a lower end piece (8*a*), an inner telescopic tubular unit, comprising a gas spring (1) having a cylinder (2) and a piston rod (3), the piston rod (3) of the gas spring being axially secured at its lower end to the end piece (8*a*), an annular guide unit (9) inserted into the outer telescopic unit (8) for guiding the inner telescopic unit in axial, substantially wobble-free movement relative to the outer unit (8), characterized in that the annular guide unit (9) comprises a carrier sleeve (10) having two closed ring sections (117) adjacent the axial ends thereof and an axially-spaced guide ring body (11) located within each closed ring section, each guide ring body (11) having an internal surface for sliding engagement with the external surface of the inner telescopic unit, each guide ring body (11) having a generally convex external surface which is received in a universal joint manner in a complementary, generally concave surface (13) formed by an internal circumferential groove (12) on the inside of the carrier sleeve (10), the carrier sleeve (10) being provided with circumferential-spaced slots (119) formed over each closed ring section and extending axially from the adjacent open end of the sleeve (10) over a portion of the length of the sleeve (10) in which the circumferential groove (12) is formed.

* * * * *

UNITED STATES PATENT AND TRADEMARK OFFICE

CERTIFICATE OF CORRECTION

PATENT NO. : 4,848,524

DATED : July 18, 1989

INVENTOR(S) : Hans-Josef Hosan and Gregor Poertzgen

It is certified that error appears in the above-identified patent and that said Letters Patent is hereby corrected as shown below:

Col. 1, line 17, "springs" should read --spring--;
Col. 3, line 35, "a a" should read --a--;
Col. 4, line 49, "coating" should read --coatings--;
Col. 5, line 56, "the the" should read --the--;
Col. 8, line 4, after "(8a)," insert --and--;
Col. 8, line 20, "circumferential-" should read --circumferentially- --.

Signed and Sealed this

Twenty-eighth Day of August, 1990

*Attest:*

HARRY F. MANBECK, JR.

*Attesting Officer*

*Commissioner of Patents and Trademarks*